US008328079B2

(12) United States Patent
Kohler

(10) Patent No.: US 8,328,079 B2
(45) Date of Patent: Dec. 11, 2012

(54) CARTON WITH DISPLAY HEADER

(75) Inventor: Karl A. Kohler, Bartlett, IL (US)

(73) Assignee: Graphic Packaging International, Inc., Marietta, GA (US)

( * ) Notice: Subject to any disclaimer, the term of this patent is extended or adjusted under 35 U.S.C. 154(b) by 210 days.

(21) Appl. No.: 12/794,181

(22) Filed: Jun. 4, 2010

(65) Prior Publication Data

US 2010/0308104 A1 Dec. 9, 2010

Related U.S. Application Data

(60) Provisional application No. 61/217,885, filed on Jun. 5, 2009.

(51) Int. Cl.
*B65D 17/28* (2006.01)

(52) U.S. Cl. ..... 229/244; 229/240; 206/427

(58) Field of Classification Search ..... 229/244, 229/223; 206/162

See application file for complete search history.

(56) References Cited

U.S. PATENT DOCUMENTS

| | | | | |
|---|---|---|---|---|
| 499,655 | A | | 6/1893 | Clark |
| 642,121 | A | | 1/1900 | Hildreth |
| 1,503,161 | A | | 7/1924 | Hornecker |
| 1,634,073 | A | | 6/1927 | Labombarde |
| 1,656,919 | A | | 1/1928 | Marsh |
| 1,762,704 | A | | 6/1930 | Smith |
| 1,901,483 | A | | 3/1933 | Ware, Jr. |
| 1,925,102 | A | | 9/1933 | Levkoff |
| 1,951,408 | A | | 3/1934 | Haven |
| 2,027,079 | A | | 1/1936 | Weiss |
| 2,141,743 | A | | 12/1938 | Ethridge |
| 2,145,430 | A | | 1/1939 | New |
| 2,152,079 | A | | 3/1939 | Mott |
| 2,196,243 | A | | 4/1940 | Bensel |
| 2,290,971 | A | | 7/1942 | King |
| 2,330,294 | A | | 9/1943 | Leavitt et al. |
| 2,416,332 | A | | 2/1947 | Lehman |
| 2,442,699 | A | * | 6/1948 | Locke, Jr. ..... 206/359 |
| 2,643,589 | A | | 6/1953 | Weiss |
| 2,679,349 | A | | 5/1954 | Mullinix |
| 2,710,134 | A | | 6/1955 | Schroeder et al. |
| 2,791,362 | A | | 5/1957 | Nute |
| 2,875,938 | A | | 3/1959 | Bramhill |

(Continued)

FOREIGN PATENT DOCUMENTS

DE 2320190 A1 11/1973

(Continued)

*Primary Examiner* — Gary Elkins
*Assistant Examiner* — Christopher Demeree
(74) *Attorney, Agent, or Firm* — Womble Carlyle Sandridge & Rice, LLP

(57) ABSTRACT

More than one embodiment of a blank and carton are provided. In one embodiment, a blank forms a carton with an opening flap that forms a display header for the carton. The opening flap is defined along a tear line pattern in a side panel and an overlapped and adhered end flap configuration, with the overlapped portion defined along a fold line. The opening flap is foldable along the fold line to dispose interior surfaces of the overlapped end flaps in facing relationship with one another. A portion of the opening flap extends into the carton interior, and can be received into two tuck-in flaps formed in another side panel. A display header is formed of the exposed portion of the opening flap when the opening flap is oriented in a display configuration. In another embodiment, only one tuck-in flap is included.

20 Claims, 10 Drawing Sheets

U.S. PATENT DOCUMENTS 2,967,610 A 1/1961 Ebert et al.
3,002,613 A 10/1961 Merkel et al.
3,090,483 A 5/1963 Algree et al.
3,157,342 A 11/1964 Grady
3,265,283 A 8/1966 Farquhar
3,276,665 A 10/1966 Rasmussen
3,276,667 A 10/1966 Johnson et al.
3,280,968 A 10/1966 Craine
3,434,648 A 3/1969 Du Barry, Jr.
3,653,495 A 4/1972 Gray
3,677,458 A 7/1972 Gosling
3,721,339 A 3/1973 Seyer
3,759,378 A 9/1973 Werth
3,786,914 A 1/1974 Beutler
3,884,348 A 5/1975 Ross
4,008,849 A 2/1977 Baber
4,058,206 A 11/1977 Morse et al.
4,111,297 A 9/1978 Paulin
4,113,100 A 9/1978 Soja et al.
4,201,291 A 5/1980 Davidson
4,363,400 A 12/1982 Lewis
4,417,655 A 11/1983 Forbes, Jr.
4,519,538 A 5/1985 Omichi
4,558,785 A 12/1985 Gordon
4,586,643 A 5/1986 Halabisky et al.
4,694,955 A 9/1987 Rank, Jr.
4,742,917 A 5/1988 Bornwasser et al.
4,756,408 A 7/1988 Grauf
4,760,952 A 8/1988 Wachter et al.
4,773,541 A 9/1988 Riddell
4,815,609 A 3/1989 Kiedaisch
4,886,160 A 12/1989 Kligerman
5,181,650 A 1/1993 Hollander et al.
5,368,194 A 11/1994 Oliff et al.
5,505,372 A 4/1996 Edson et al.
5,509,534 A 4/1996 Taravella et al.
5,690,213 A 11/1997 Matsumura
5,699,957 A 12/1997 Blin et al.
5,722,583 A 3/1998 Focke et al.
5,752,597 A 5/1998 Brangle, Jr.
5,783,030 A 7/1998 Walsh
5,788,117 A 8/1998 Zimmanck
5,842,576 A 12/1998 Snow
5,857,570 A 1/1999 Brown
5,878,947 A 3/1999 Hoy et al.
5,881,884 A 3/1999 Podosek
5,921,398 A 7/1999 Carroll
5,927,498 A 7/1999 Saam
5,979,749 A 11/1999 Bozich
6,015,084 A 1/2000 Mathieu et al.
D431,462 S 10/2000 Menaged et al.
6,129,211 A 10/2000 Prakken et al.
6,135,289 A 10/2000 Miller
6,158,579 A 12/2000 Rosenbaum
D438,791 S 3/2001 Tsuruishi et al.
D439,157 S 3/2001 Tsuruishi et al.
D441,285 S 5/2001 Tsuruishi et al.
D441,643 S 5/2001 Tsuruishi et al.
6,296,121 B1 10/2001 Hershey
6,371,365 B1 4/2002 Doucette et al.
6,386,369 B2 5/2002 Yuhas et al.
6,402,021 B1 6/2002 Heathcock
6,409,077 B1 6/2002 Telesca et al.
6,419,152 B1 7/2002 Tokarski
6,435,351 B1 8/2002 Gibb
6,435,403 B1 8/2002 Giblin et al.
6,478,159 B1 11/2002 Taylor et al.
6,510,982 B2 1/2003 White et al.
6,523,692 B2 2/2003 Gregory
6,631,803 B2 * 10/2003 Rhodes et al. ..... 206/427
6,729,475 B2 5/2004 Yuhas et al.
6,755,306 B2 6/2004 Maus
6,811,028 B2 11/2004 Kim et al.
6,854,639 B2 2/2005 Walsh
6,913,189 B2 7/2005 Oliff et al.
6,918,487 B2 7/2005 Harrelson
6,923,365 B2 8/2005 Auclair et al.
7,000,773 B2 2/2006 Hubbs et al.
7,004,897 B2 2/2006 Spivey, Sr.
7,021,468 B2 4/2006 Cargile, Jr.
D532,685 S 11/2006 Reussner
7,201,714 B2 4/2007 Zoeckler et al.
7,225,930 B2 6/2007 Ford et al.
7,258,265 B2 8/2007 Loew
7,284,662 B2 10/2007 DeBusk et al.
7,320,407 B2 1/2008 Hubbs et al.
7,328,834 B2 2/2008 Harrelson
7,546,924 B2 6/2009 Oliveira
7,614,497 B2 11/2009 Spivey, Sr.
7,628,746 B2 12/2009 Varanasi
7,784,617 B2 8/2010 Urban
2001/0000203 A1 4/2001 Yuhas et al.
2001/0001447 A1 5/2001 Gregory
2002/0043554 A1 4/2002 White et al.
2002/0170845 A1 11/2002 Oliff
2003/0024848 A1 2/2003 Oycke
2004/0099570 A1 5/2004 Cargile
2005/0092649 A1 5/2005 Ford et al.
2005/0155905 A1 7/2005 Monk
2005/0167291 A1 8/2005 Sutherland
2005/0199690 A1 9/2005 Peterson
2005/0218203 A1 10/2005 Harrelson
2006/0006096 A1 1/2006 Funk
2006/0243739 A1 11/2006 Sherman et al.
2006/0266815 A1 11/2006 Coltri-Johnson et al.
2007/0000934 A1 1/2007 Wolpow
2009/0014353 A1 1/2009 Lewis, Jr. et al.
2009/0314661 A1 12/2009 Fisher et al.

FOREIGN PATENT DOCUMENTS

DE 3627019 A1 2/1988
DE 29817195 U1 11/1998
DE 20216854 U1 1/2003
EP 0133595 A2 2/1985
EP 0704386 A1 4/1996
FR 1379931 A 11/1964
FR 2882032 A1 8/2006
GB 1218016 A 1/1971
GB 2238776 A 6/1991
JP 03275438 A 12/1991
WO WO-9831593 A1 7/1998
WO WO-03082686 A1 10/2003
WO WO-2004063031 A1 7/2004
WO WO-2005/110866 A1 11/2005

* cited by examiner

CARTON WITH DISPLAY HEADER

CROSS-REFERENCE TO RELATED APPLICATION

This application claims the benefit of U.S. Provisional Application No. 61/217,885, which was filed on Jun. 5, 2009.

INCORPORATION BY REFERENCE

U.S. Provisional Application No. 61/217,885, which was filed on Jun. 5, 2009, is hereby incorporated by reference for all purposes as if presented herein in its entirety.

BACKGROUND

Cartons are useful for holding and transporting articles. In order to facilitate dispensing of articles from a carton, it can be beneficial to form a dispenser with a portion of the carton.

SUMMARY

The present disclosure generally relates to blanks, packages, cartons, or other, similar containers or packaging materials for holding and/or dispensing products, such as food items, cans, packages, bottles, and various other articles including pre-packaged items.

In one aspect, the present invention includes a carton that includes a first side panel, a second side panel, a third side panel, and a fourth side panel. A first end of the carton is formed by a first side panel end flap, a second side panel end flap, a third side panel end flap, and a fourth side panel end flap. A first portion in the first end is defined between a peripheral edge of the first side panel end flap and a fold line in the first side panel end flap. The third side panel end flap overlaps and is adhered to the first portion of the first side panel end flap. A second end of the carton is formed by a fifth side panel end flap, a sixth side panel end flap, a seventh side panel end flap, and an eighth side panel end flap. An opening flap that includes a second portion is defined in the third side panel by a tear line pattern. The opening flap is separable along the tear line pattern and is foldable along the first fold line to dispose the first side panel end flap and the third side panel end flap in a facing relationship, and to dispose the second portion in a facing relationship with an inner surface of the first side panel inside the carton. Optionally, the entirety of the second portion can be disposed inside the carton. Optionally still, when the opening flap is folded along the first fold line, at least a section of the third panel end flap can extend inside the carton. The tear line pattern can include a finger flap where the tear line pattern is initially separated. At least one tuck-in flap also can be included in the first side panel. The at least one tuck-in flap can be sized to receive an edge of the second portion when the opening flap is folded along the first fold line and the second portion is disposed inside the carton.

In another aspect, the present invention includes a package that includes a carton and a plurality of articles. The carton can have a first side panel, a second side panel, a third side panel, and a fourth side panel. A first end of the carton is formed by a first side panel end flap, a second side panel end flap, a third side panel end flap, and a fourth side panel end flap. A first portion of the first end is defined between a peripheral edge of the first side panel end flap and a fold line in the first side panel end flap. The third side panel end flap overlaps and is adhered to the first portions of the first side panel end flap. A second end of the carton is formed by a fifth side panel end flap, a sixth side panel end flap, a seventh side panel end flap, and an eighth side panel end flap. An opening flap that includes a second portion is defined in the third side panel by a tear line pattern. The opening flap is separable along the tear line pattern and is foldable along the first fold line (1) to dispose the first side panel end flap and the third side panel end flap in a facing relationship, and (2) to dispose the second portion in a facing relationship with an inner surface of the first side panel inside the carton. Optionally, the entirety of the second portion can be disposed inside the carton. Optionally still, when the opening flap is folded along the first fold line, at least a section of the third panel end flap can extend inside the carton. The tear line pattern can include a finger flap, with detachment of a portion of the carton along the tear line pattern being initiated at the finger flap. At least one tuck-in flap can be included in the first side panel. The at least one tuck-in flap can be sized to receive an edge of the second portion when the opening flap is folded along the first fold line and the second portion is disposed inside the carton.

Those skilled in the art will appreciate the above-stated advantages and other advantages and benefits of various additional embodiments upon reading the following detailed description of the exemplary embodiments with reference to the below-listed drawing figures.

According to common practice, the various features of the drawings discussed below are not necessarily drawn to scale. Dimensions of various features and elements in the drawings may be expanded or reduced to illustrate more clearly the embodiments of disclosure.

BRIEF DESCRIPTION OF THE DRAWINGS

Corresponding parts are designated by corresponding reference figures throughout the drawings.

DETAILED DESCRIPTION OF EXEMPLARY EMBODIMENTS

Figure 1:
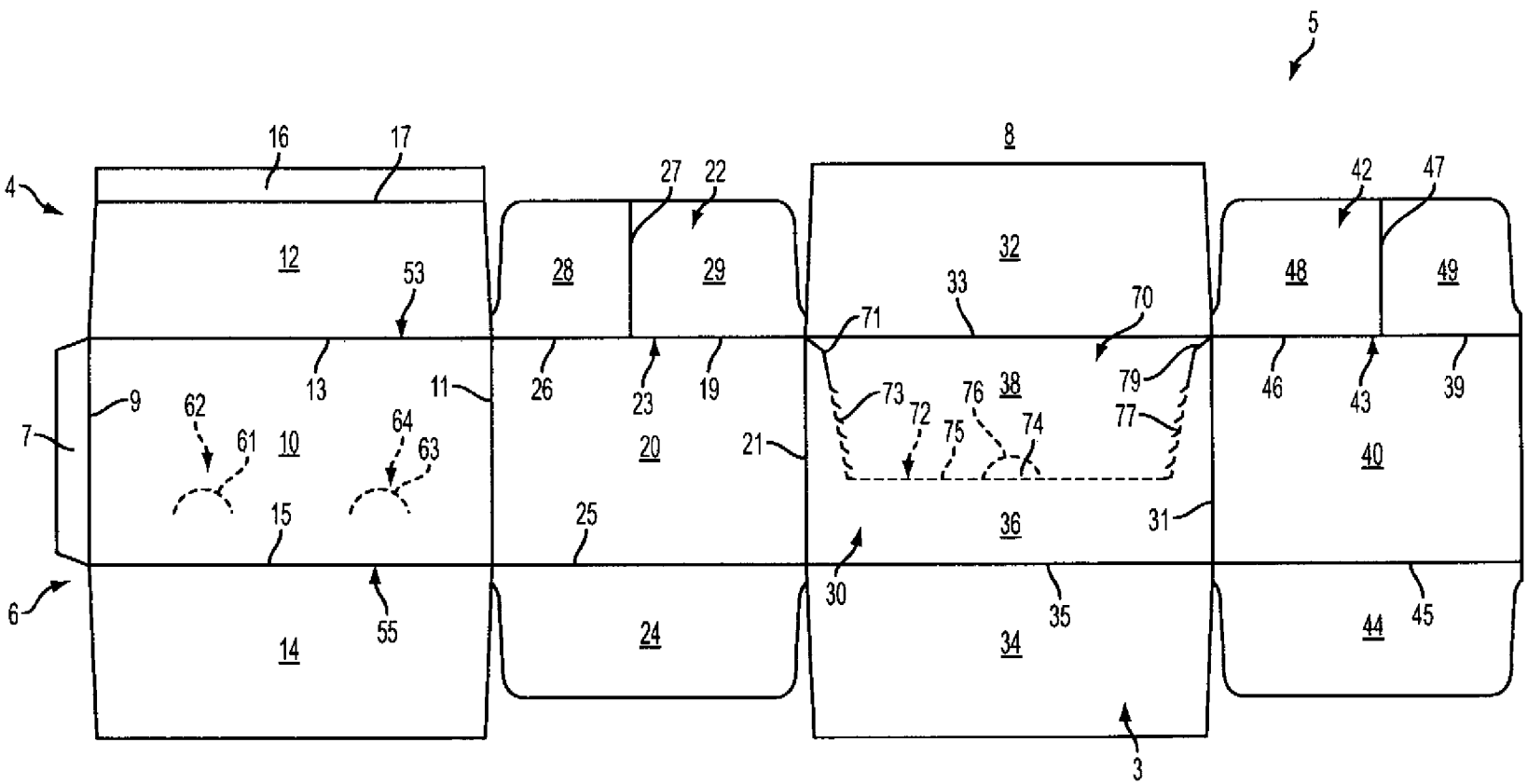
FIG. 1 is a plan view of a carton blank according to a first embodiment.

This disclosure generally relates to cartons suitable for storing and dispensing contents or articles, methods of erecting such cartons from a carton blank, methods of dispensing from the formed carton, and a carton for, and methods for, orienting a display header at a rear portion of the carton.

For purposes of illustration and not limitation, the detailed description below describes several embodiments of the invention within the context of a carton with an opener for dispensing contents or articles from the carton, and display header. Further, references herein to "end," "side," "front," "rear," "bottom," and "top" generally refer to orientations and positions of elements wherein the carton is erected and/or disposed in an upright orientation. The terms "upper," "lower," "vertical," "horizontal," and "oblique" and any variations thereof, generally refer to the location and orientation of an element or line with respect to a drawing figure in which it appears. Reference characters shared among the various embodiments disclosed herein include similar parts.

Packages according to the present disclosure can accommodate items of numerous different shapes. For the purpose of illustration and not for the purpose of limiting the scope of the disclosure, the following detailed description describes items at least partially disposed within the carton or package embodiments. In this specification, the terms "lower," "bottom," "upper," "top" and "side" indicate orientations determined in relation to fully erected sleeves, cartons, or packages, and such terms are not intended to limit the scope of the disclosure.

The present disclosure generally relates to packages, cartons, constructs, sleeves or the like, for holding and displaying containers such as cartons or packages holding food or consumer products, for example. The containers can be made from materials suitable in composition for packaging the particular food or consumer item, and the materials include, but are not limited to, cardboard, paperboard, plastic such as PET, LDPE, LLDPE, HDPE, PP, PS, PVC, EVOH, and nylon, metal(s) and the like, or other suitable materials.

The invention as shown in the example embodiments generally relates to a seal end style carton or partial seal end style carton with display features, although other types of cartons or packages also can be formed in accordance with the present invention. Generally, a score or underline of instruction is provided on an end flap, such as the inner major flap behind the area where the outer major flap adheres or glues to the inner major flap on the top of a carton. The back panel of the carton can include cuts, such as half moon cuts, or similar features to allow the portion of the face panel or opening flap separated from one of the side panels to be tucked in behind the product in the carton or package. A dye cut shape optionally could be provided on the inner major flap to pop out to provide an extension above the fold line. The minor flaps then can be removed or folded inwardly, to complete the display function of the carton. Optionally, reinforcing strips can be provided along the panels, along the end flaps, or any combination thereof. The present invention is applicable to fluted or regular folding cartons that include or do not include such reinforcing strips. The display header for the carton detailed herein is provided without the use of flap or panel extensions, and can be produced on conventional packaging equipment.

FIG. 1 shows a blank 5 according to exemplary embodiment of the invention. FIG. 1 illustrates an outer facing surface 3 of the carton blank 5 from which a sleeve 80 (FIG. 3) and carton 90 (FIG. 5) can be erected. The blank 5 (FIG. 1) includes a first end 4 and a second end 6. The blank 5 includes an adhesive flap 7, a first panel 10, a second panel 20, a third panel 30, and a fourth panel 40. Adhesive panel 7 is foldably connected along fold line 9 to panel 10, panel 10 is foldably connected along fold line 11 to panel 20, panel 20 is foldably connected along fold line 21 to panel 30, and panel 30 is foldably connected along fold line 31 to panel 40. Panel 30 is divided into dispenser portion 38 and remainder portion 36 by tear line 72. Tear line 72 can be a continuous tear line and can extend between fold line 21 and fold line 31 in panel 30, or can include individual segments, such as indicated at tear line segments 71, 73, 75, 77, and 79. Further, any combination of these tear line segments can be joined in a manner so as to be continuous therebetween, short of the entire grouping of tear line segments being continuous. Dispensing flap 70 can also include an opening feature, as shown along tear line segment 75 of tear line 72, and can be defined by tear line segment 76 to create an opening feature, such as a finger flap, 74 and dispenser portion 38. The carton can also include tuck-in flaps 62 and 64 shown in panel 10 and defined, respectively, by cuts 61 and 63. Tuck-in flaps 62 and 64 are shown as being generally arcuate, but could be formed in other sizes, orientations, and positions. Generally, cuts 62 and 64 receive at least a portion of the dispensing flap 70 (generally some portion of the end of dispenser portion 38 which is separated along tear line 72), which is tucked in or received therewithin.

Blank 5 also generally includes end flaps, including end flaps 12, 22, 32, 42 at the first end 4 and end flaps 14, 24, 34, 44 at the second end 6. End flap 12 is foldably connected along a fold line 13 at the first end 4 of panel 10. End flap 12 includes an adhesive panel 16 foldably connected along a fold line 17. End flap 14 is foldably connected along a fold line 15 at the second end 6 of panel 10. End flap 22 is foldably connected along fold line 23 to the first end 4 of panel 20. End flap 22 is divided into end flap segments 28, 29, which are connected along a fold line 27, with segment 28 connected along fold line 26 and segment 29 connected along fold line 19 to panel 20. Fold lines 26 and 19 together comprise fold line 23. End flap 24 is foldably connected along fold line 25 at the second end 6 of panel 20. End flap 32 is foldably connected along the fold line 33 at the first end 4 of panel 30. End flap 34 is foldably connected along a fold line 35 at the second end 6 of panel 30. End flap 42 is foldably connected along fold line 43 to the first end 4 of panel 40. End flap 42 is divided into end flap segments 48 and 49, which are foldably connected to one another along a fold line 47, with segment 48 foldably connected along a fold line 46, while segment 49 is connected along fold line 39 to panel 40. Fold lines 46 and 39 together comprise fold line 23. End flap 44 is foldably connected along a fold line 44 at the second end 6 of panel 40.

As shown in FIG. 1, fold lines 13, 15, 19, 23, 25, 26, 33, 35, 39, 43, 45, 46 generally extend transverse to fold lines 9, 11, 21, and 31. One or more of fold lines 13, 19, 23, 26, 33, 39, 43, 46, also could be replaced by a single fold line such as indicated at 53, while one or more of fold lines 15, 25, 35, 45 could be replaced by a single fold line, such as indicated at 55. End flaps 12, 14, 22, 24, 28, 29, 32, 34, 42, 44, 48, 49 generally extend in a direction away from respective fold lines 13, 15, 19, 23, 25, 26, 33, 35, 39, 43, 45, 46 toward the periphery 8 of the blank 5. Further, the "panels," which define the surfaces of sleeve 80 (FIG. 2) and/or carton 90 (FIG. 5) and form the blank 5, also can be referred to as "walls" or "sides." Further still, the panels 10, 20, 30, 40 can be referred to as the surface they form when constructing the form of a carton, such as the sleeve shown in FIG. 2 or the carton shown in FIG. 5. For example, panel 10 can be referred to as the back panel, panel 20 can be referred to as first side panel, panel 30 can be referred to as front panel, and panel 40 can be referred to as second side panel. Additionally, end flaps 12, 22, 28, 29, 32, 42, 48, 49 can be closed to form a first end, such as a top end, and end flaps 14, 24, 34, 44 can be closed to form a second end, such as a bottom end, as shown in FIG. 4.

Figure 2:
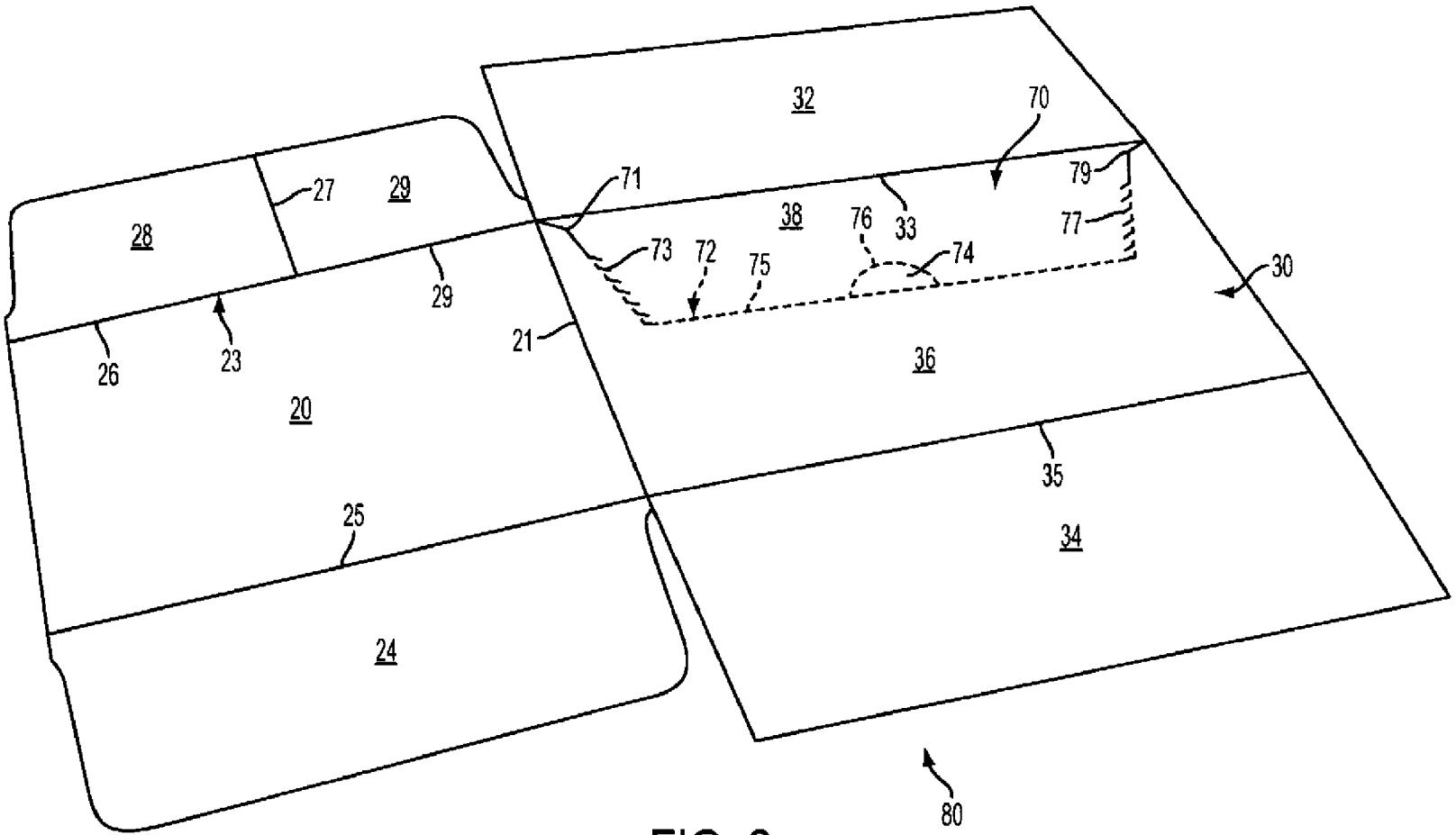
FIG. 2 shows the blank of FIG. 1 with portions folded for forming the blank into a sleeve.

FIG. 2 illustrates the holding of the panels into a sleeve 80 formed from the blank 5 panels of FIG. 1. The blank 5 may be folded along fold lines 9, 11, and 31, and an adhesive, such as glue, can be applied to adhesive panel 7 (such as along an outer surface 3) to secure the panels of the blank 5 into a sleeve configuration, such as shown at 80 in FIG. 2. Generally, the adhesive flap 7 is adhered to an inner surface of panel 40. Alternatively, adhesive can be applied to an interior surface of panel 40 against which the adhesive flap 7 then is received.

Figure 3:
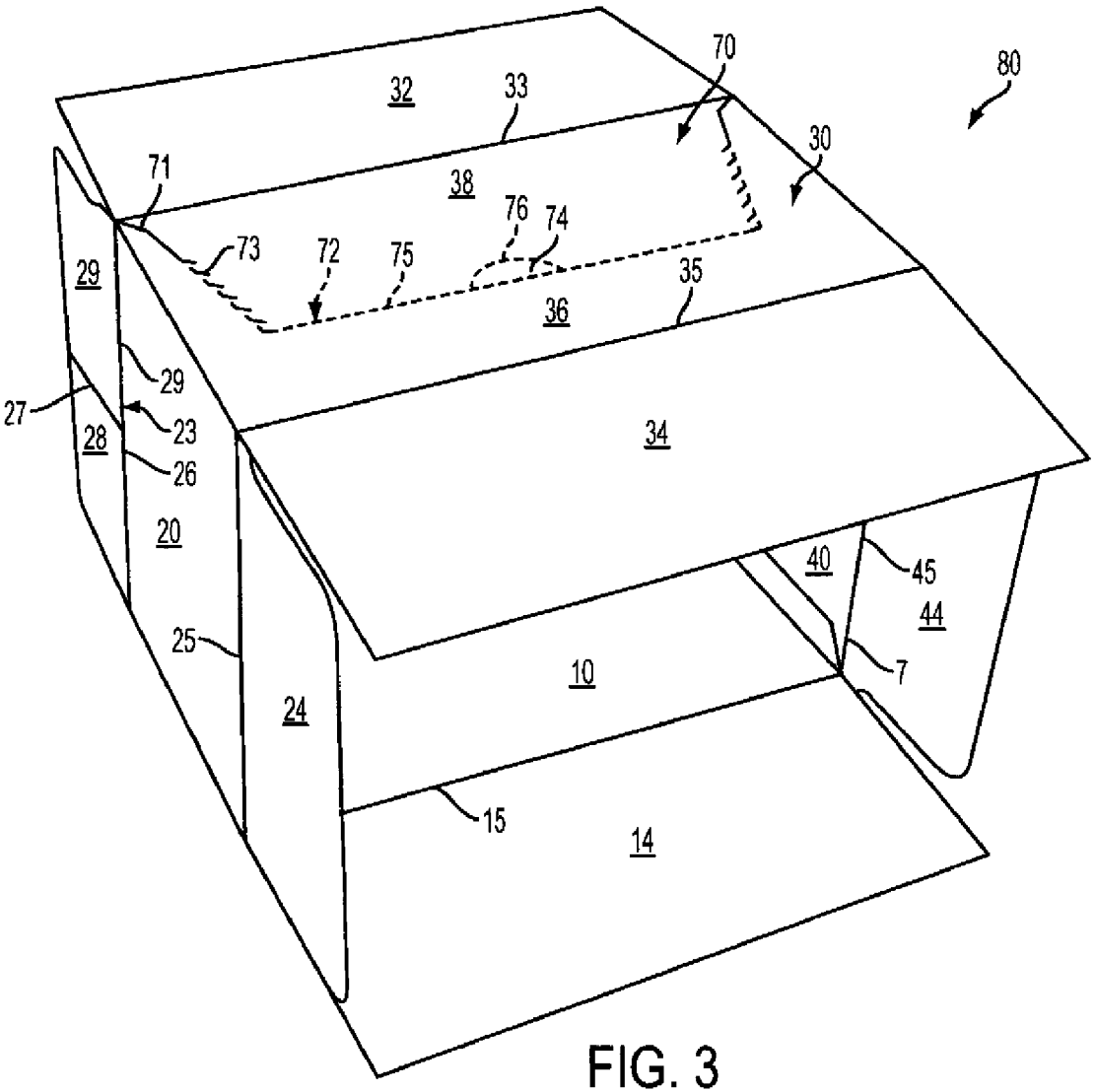
FIG. 3 shows the sleeve of FIG. 2 expanded into an open configuration.

FIG. 3 shows the sleeve 80 of FIG. 2 as it progresses from a flat configuration with selected portions folded (FIG. 2) to an open sleeve configuration (FIG. 3). In the configuration shown in FIG. 3, for example, the sleeve 80 can be filled with product, or otherwise can receive product therein. To complete the formation of the sleeve 80 from the substantially flat blank configuration shown in FIGS. 1-2 to the sleeve configuration shown in FIG. 3, generally, the panels 10, 20, 30, and 40 and adhesive panel 7 are folded along fold lines 9, 11, 21, and 31 to form the open sleeve configuration 80.

Figure 4:
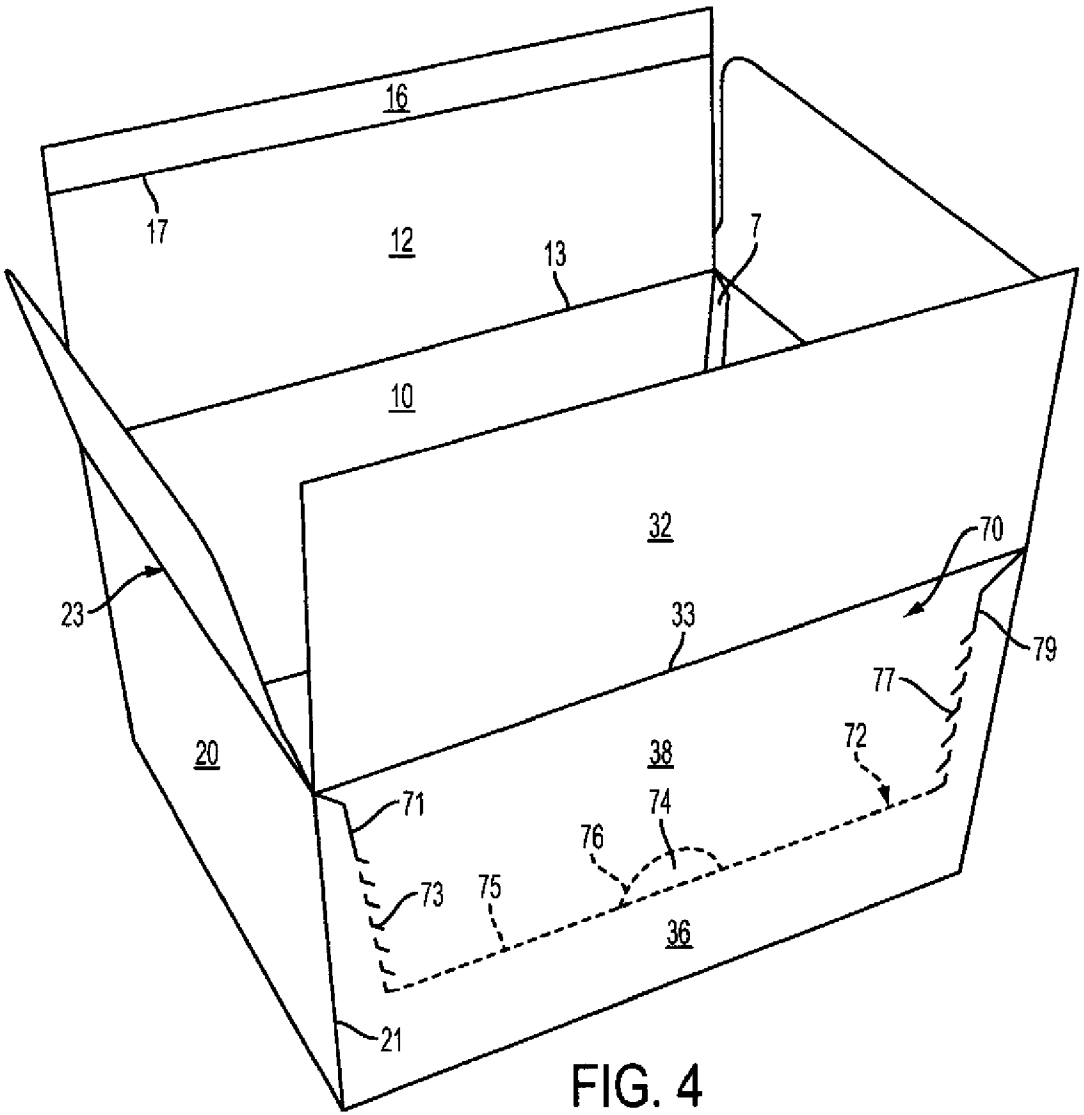
FIG. 4 shows the sleeve of FIG. 3 with bottom end flaps folded to form a bottom end of an open carton.

FIG. 4 shows the end flaps 14, 24, 34, 44 folded to form a bottom end to the sleeve/carton so as to define an open box configuration. To proceed from the open sleeve configuration shown in FIG. 3 to the open box configuration shown in FIG. 4, end flap 14 is folded along fold line 15, end flap 24 is folded along fold line 25, end flap 34 is folded along fold line 35, and end flap 44 is folded along fold line 45. Generally, end flaps 24 and 44 are folded inwardly towards the interior of the carton prior to folding end flaps 14 and 34 inwardly towards the interior of the carton, though a variety of folding configurations are envisioned.

Figure 5:
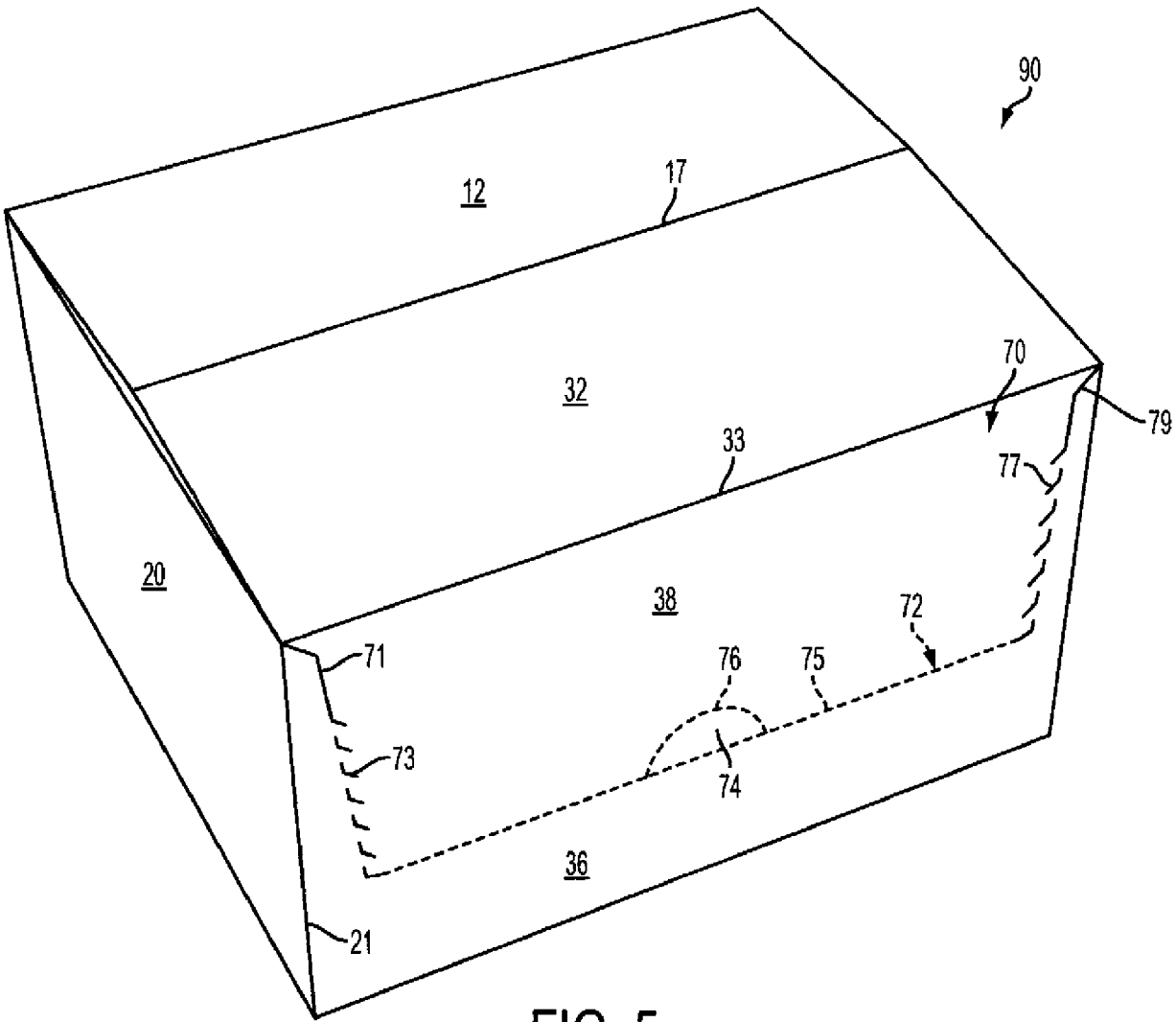
FIG. 5 shows an enclosed carton formed by folding the end flaps at the top end of the carton.

FIG. 5 shows a configuration of an enclosed carton 90 formed by folding end flaps 12, 22, 28, 29, 32, 42, 48, 49 (FIG. 1) to form a top end of the carton. To enclose the top end of the carton in similar fashion to the formation of the bottom end, end flap 12 is folded along fold line 13, end flap 22 is folded along fold line 23 (or end flap segments 28 and 29 are folded along fold lines 26 and 29), end flap 32 is folded along fold line 33, end flaps 42 is folded along fold line 43 (or end flap segments 48 and 49 are folded along fold lines 46 and 49). Generally, end flaps 22 (or 28/29) and end flaps 42 (or 48/49) are folded inwardly toward an interior of the carton prior to folding end flaps 12 and 32. End flap 12 generally also is folded immediately prior to folding end flap 32, to dispose end flaps 12 and 32 in an overlapping configuration with flap 32 disposed over flap 12. Specifically, end flap 12 includes an adhesive panel segment 16 that is foldably connected along fold line 17. When the top end is closed in the configuration shown in FIG. 5, generally, an adhesive is applied to outer surface 3 of adhesive panel 16 to adhere to adhesive panel 16 to an interior surface of end flap 32. Alternatively, the interior surface of flap 32 can receive the adhesive.

Figure 6:
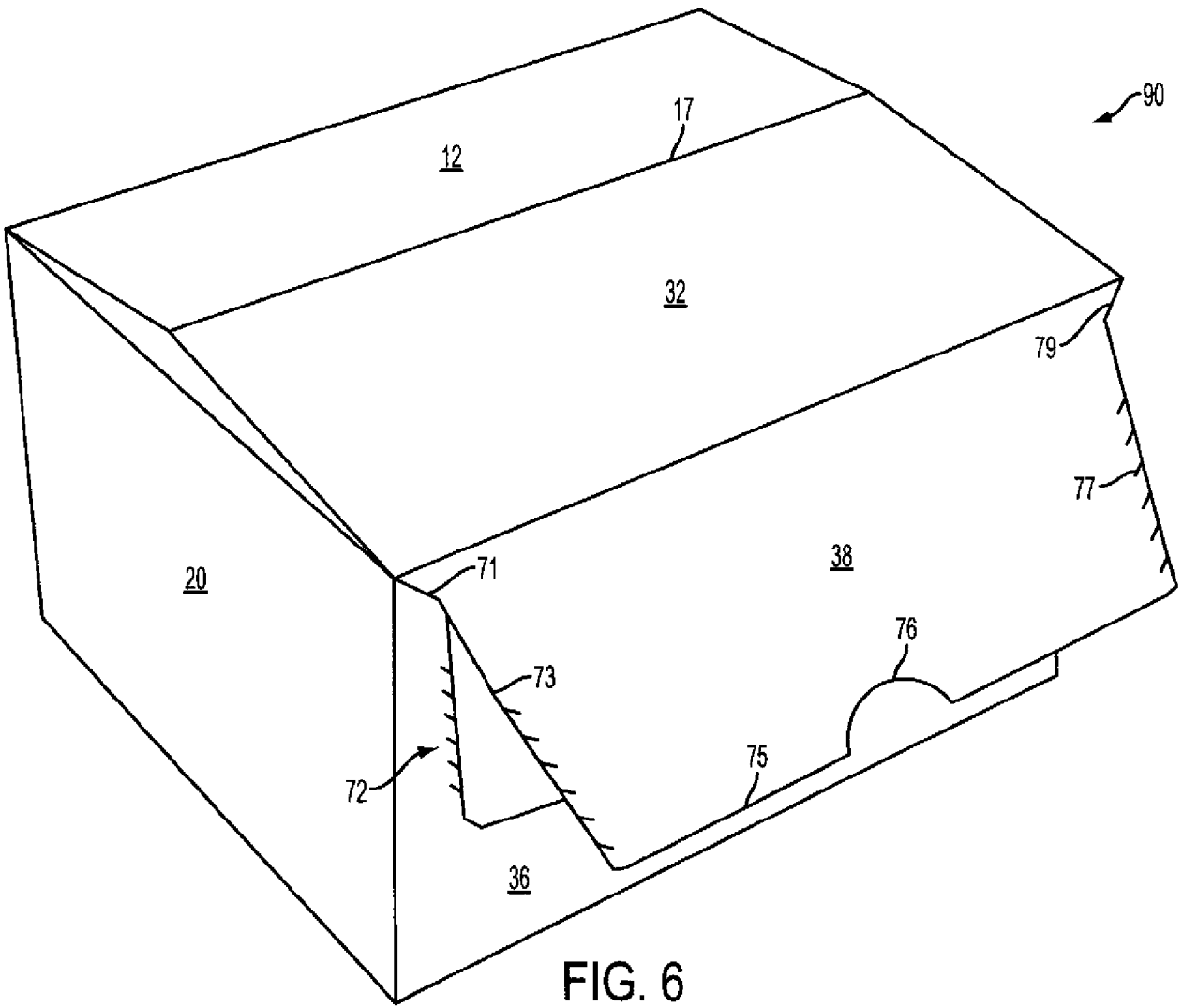
FIG. 6 shows the carton of FIG. 5 with the dispensing flap being opened.

FIG. 6 shows the carton 90 with the dispensing flap 70 being separated along tear line 72 (not shown) (or along tear lines 71, 73, 75, 76, 77, and 79 if individual tear lines are included). Generally, opening feature 74 is depressed slightly into the interior of the carton 90 to be separated along tear line 76. Then, separation of dispensing flap 70 continues along tear line 72 to separate dispensing portion 38 from the remainder portion 36 of the carton.

Figure 7:
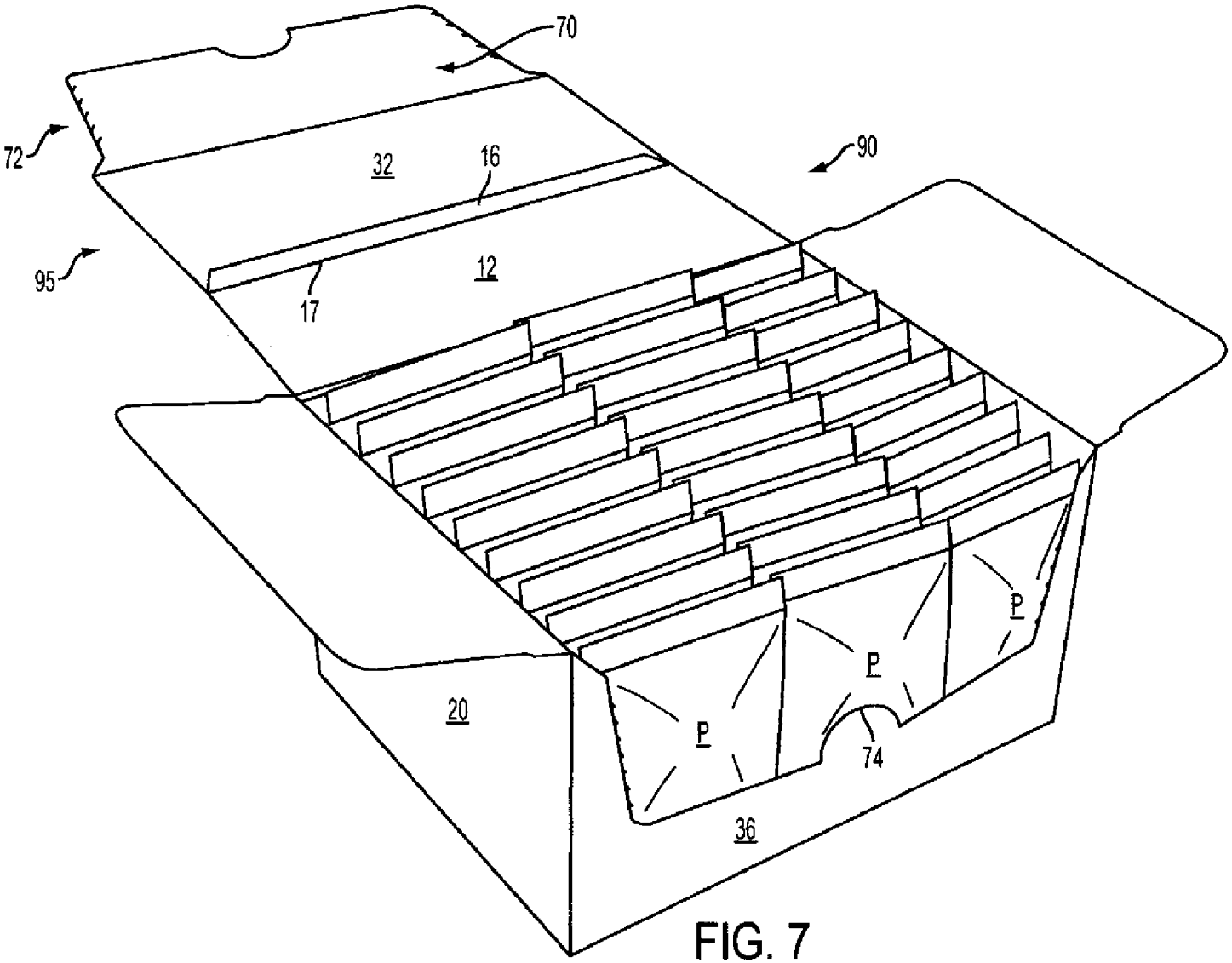
FIG. 7 shows the carton of FIG. 5 with the dispensing flap fully opened.
Figure 8:
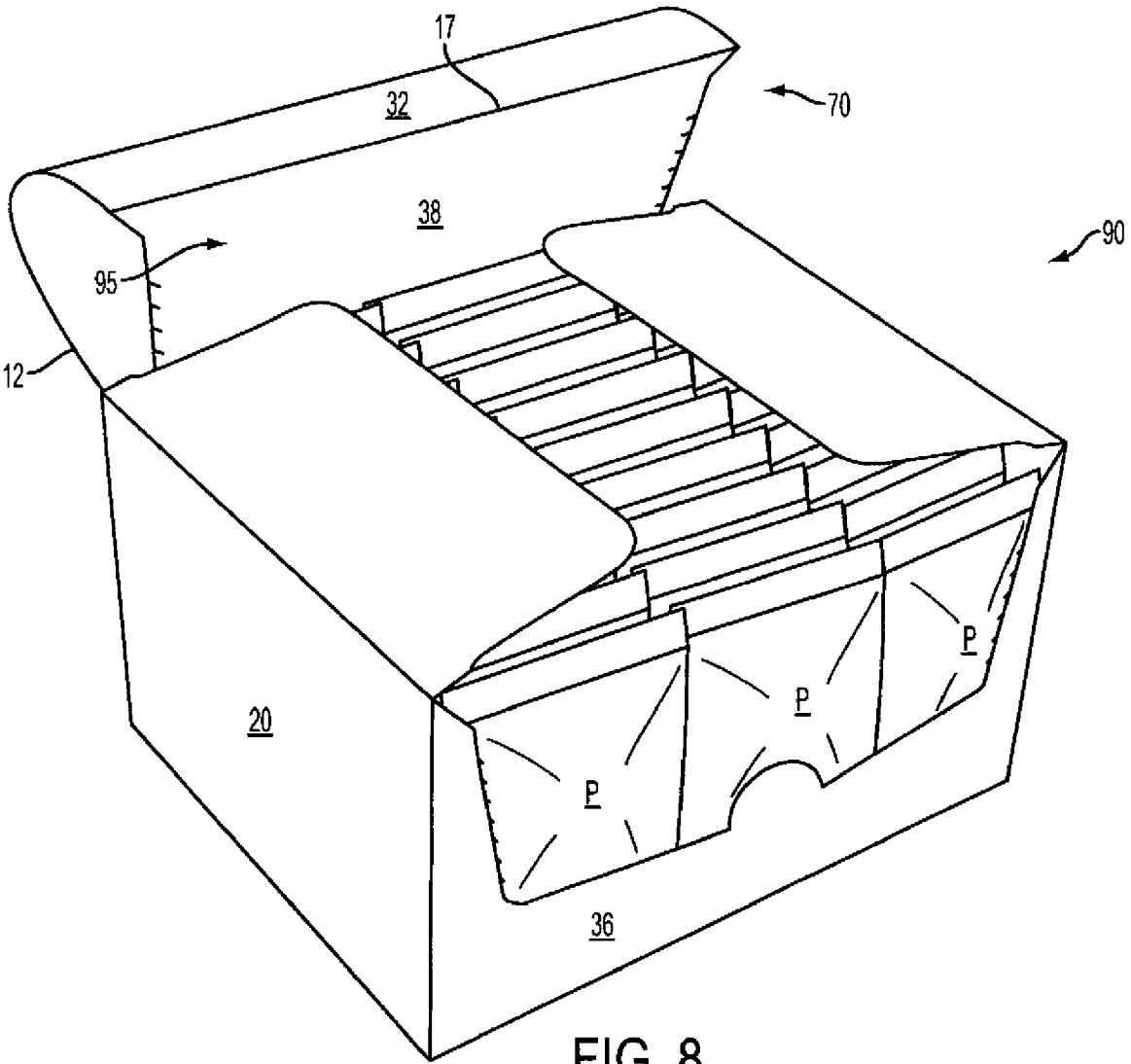
FIG. 8 shows the dispensing flap being folded and tucked in behind the product in the carton to form a display header.

FIG. 7 shows the dispensing flap 70 entirely detached along tear line 72 (not shown) and opened to expose product P of carton 90. The dispensing flap 70 can be disposed in a display position on orientation to form a display header 95 (not shown). FIG. 8 shows the dispensing flap 70 being folded into position behind the product in the interior of the carton 90 to form display header 95.

Figure 9:
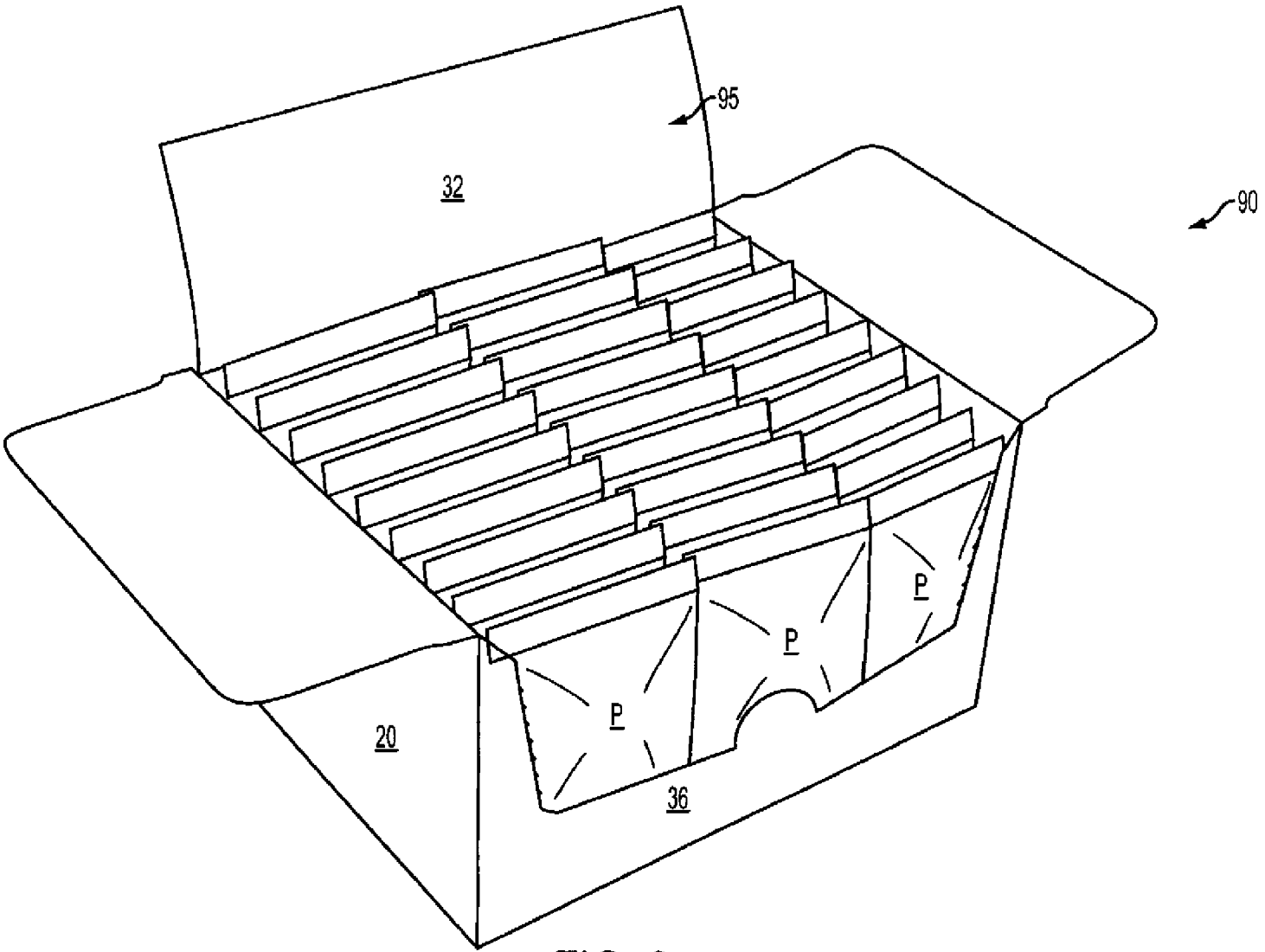
FIG. 9 shows the display header formed by tucking the dispensing flap into the carton.

FIG. 9 shows the display header 95 in display position. Generally, display header 95 is formed by folding dispensing flap 70 along fold line 17 (not shown) and placing dispensing flap 70 into the display position, such as with end flaps 12 and 32 in a facing relationship and with dispensing portion 38 received into cuts 62 and 64 (not shown).

Figure 10:
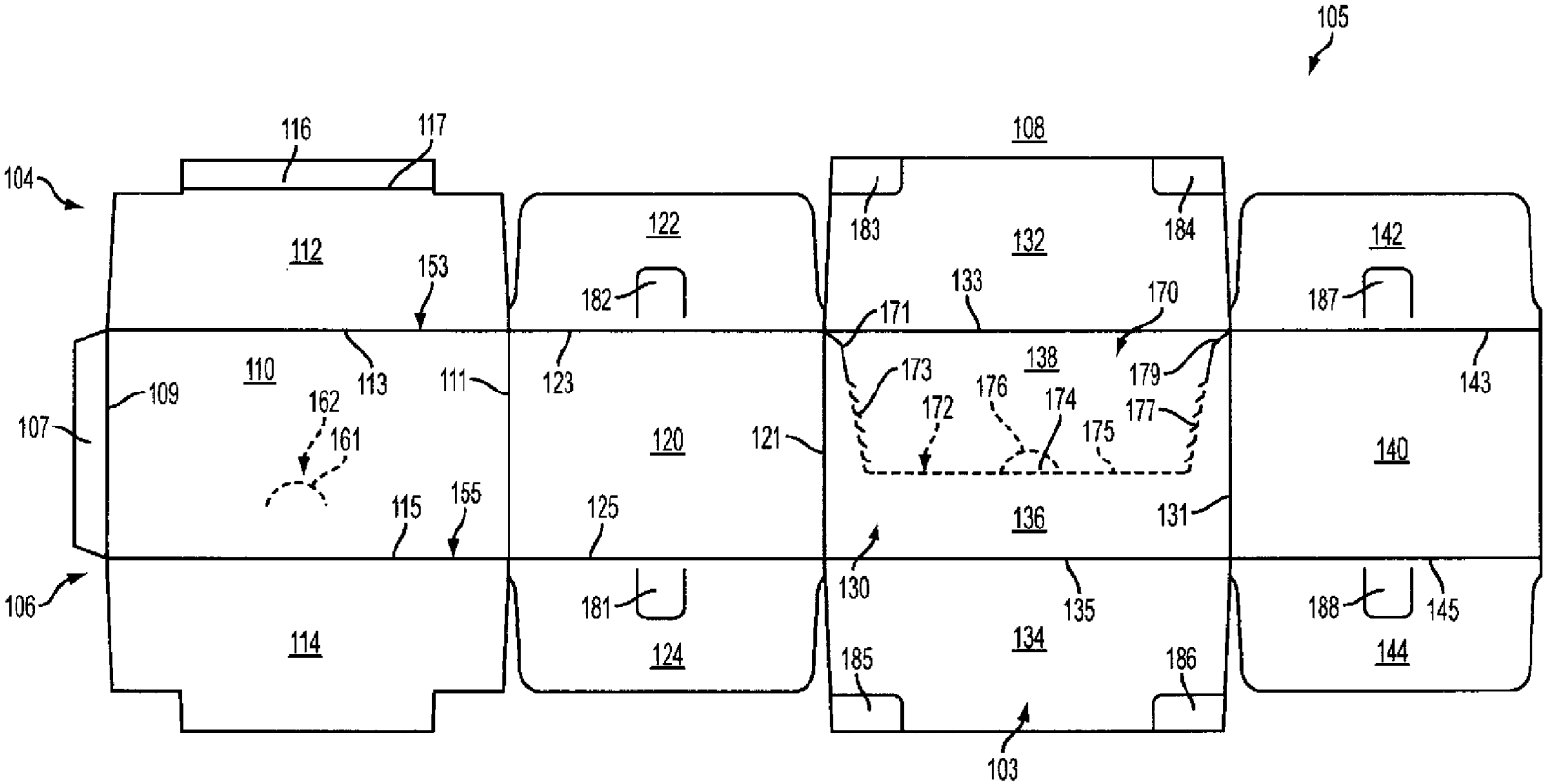
FIG. 10 shows a plan view of a carton blank according to a second embodiment.

FIG. 10 shows a plan view of a carton blank according to a second embodiment, illustrating an outer facing surface 103 of a carton blank 105 from which a carton (not shown) can be erected. The blank 105 includes a first end 104, second end 106, and adhesive panel 107, a first panel 110, a second panel 120, a third panel 130 and a fourth panel 140. Adhesive panel 107 is foldably connected along a fold line 109 to panel 110, panel 110 is foldably connected along a fold line 111 to panel 120, panel 120 is foldably connected along a fold line 121 to panel 130, and panel 130 is foldably connected along a fold line 131 to panel 140. Panel 130 is divided into dispenser portion 138 and remainder portion 136 by tear line 172. Tear line 172 can be a continuous tear line and can extend between fold line 121 and fold line 131 in panel 130, or can include individual segments, such as indicated at tear line segments 171, 173, 175, 177, and 179. Further, any combination of these tear line segments can be joined or formed together so as to be continuous therebetween, short of the entire grouping of tear line segments being continuous. Dispensing flap 170 can also include an opening feature, as shown along tear line segment 175 of tear line 172, and can be defined by tear line segment 176 to create an opening feature, such as a finger flap, 174 and dispenser portion 138. The carton can also include a tuck-in flap 162 shown in panel 110 and defined by a cut 161. Tuck-in flap 162 is shown in the present embodiment as generally arcuate, but could be formed in other sizes, orientations, and positions. Generally, tuck-in flap 162 receives at least a portion of the dispensing flap 170 (generally some portion of the end of dispenser portion 138 which separated along tear line 172), which is tucked in or received therewithin.

Blank 105 includes end flaps, including end flaps 112, 122, 132, 142 at the first end 104 and end flaps 114, 124, 134, 144 at the second end 106 of blank 105. End flap 112 is foldably connected along a fold line 113 at the first end 104 of panel 110. End flap 114 is foldably connected along a fold line 115 at the second end 106 of panel 110. End flap 122 is foldably connected along a fold line 123 at the first end 106 of panel 120. End flap 124 is foldably connected along a fold line 125 at the second end 106 of panel 120. End flap 132 is foldably connected along a fold line 133 at the first end 104 of panel 130. End flap 134 is foldably connected along a fold line 135 at the first end 106 of panel 130. End flap 142 is foldably connected along a fold line 143 at the first end 104 to panel 140. End flap 144 is foldably connected along a fold line 145 at the second end 106 of panel 140. End flap 112 includes an adhesive panel 116 foldably connected along a fold line 117.

As shown in FIG. 10, fold lines 113, 115, 123, 125, 133, 135, 143, 145 generally extend transverse to fold lines 109, 111, 121, 131. One or more of fold lines 113, 123, 133, 143, also could be replaced by a single fold line such as indicated at 153, while one or more of fold lines 115, 125, 135, 145 could be replaced by a single fold line such as indicated at 155. End flaps 112, 114, 122, 124, 132, 134, 142, 144 generally extend in a direction away from respective fold lines 113, 115, 123, 125, 133, 135, 143, 145 toward a periphery 108 of blank 105. Further, the "panels," which define the surfaces of a carton formed from the blank 105, also can be referred to as "walls" or "sides." Further still, the panels 110, 120, 130, 140 can be referred to as the surfaces they form when constructed in the form of a carton or sleeve. For example, panel 110 can be referenced as back panel, panel 120 can be referenced as first side panel, panel 130 can be referenced as front panel, and panel 140 can be referenced as second side panel. Additionally, end flaps 112, 122, 132, 142 can be closed to form a first end, such as a top end, and end flaps 114, 124, 134, 144 can be closed to form a second end, such as a bottom end.

Although glue can be included where needed to secure the blank 105 into form as a sleeve or carton, for exemplary purposes, glue spots are shown at 183, 184, 185, and 186.

The blank 5 and its panels, flaps, and lines can be formed of any size and configuration as desired. For exemplary purposes only, and not to limit the scope of the invention, the blank 5 shown in FIG. 1 can have an overall length of about ±34 inches, although other sizes also can be provided, and can have an overall width of about ±13 inches, although other sizes also can be provided. Panel 7 can have a width of about ±1 inch, such as ±0.750 inches, panel 10 can have a width of about ±9 inches, such as ±9.250 inches, panel 20 can have a width of about ±7 inches, such as ±7.250 inches, panel 30 can have a width of about ±9 inches, such as ±9.250 inches, and panel 40 can have a width of about ±7 inches, although other sizes also can be provided. Panels 10, 20, 30, 40 can have a width of about ±5.5 inches, flaps 12, 14, 32, and 34 can have a width of about ±4 inches, and flaps 22, 24, 42, and 44 can have a width of up to about ±3 inches, such as at ±3.125 inches and a portion of flaps 22, 24, 42, and 44 can have a width adjacent panels 20 and 40 of about ±0.5 inches, although other sizes also can be provided. Adhesive panel 16 can have a width of about ±0.750 inches, and panel 7 can have edges that extend at an angle of about ±20 degrees with respect to fold lines 53 and 55. The width of remainder portion 36 between tear line segment 75 and fold line 35 can be about ±2.000 inches. A reinforcing layer, if included, can have a width of about ±5 inches, although other sizes also can be provided. As noted, the exemplary spacing/distances are variable, depending on the size of the blank.

The blank 105 and its panels, flaps, and lines can be formed of any size and configuration as desired. For exemplary purposes only, and not to limit the scope of the invention, the blank 105 shown in FIG. 10 can have an overall length of about ±34 inches, although other sizes also can be provided, and can have an overall width of about ±13 inches, although other sizes also can be provided. Panel 107 can have a width of about ±1 inch, such as ±0.750 inches, panel 110 can have a width of about ±9 inches, panel 120 can have a width of about ±7 inches, panel 130 can have a width of about ±9 inches, and panel 140 can have a width of about ±7 inches, although other sizes also can be provided. Panels 110, 120, 130, 140 can have a width of about ±5.5 inches, such as ±5.375 inches, flaps 112, 114, 132, and 134 can have a width of about ±4 inches, and flaps 122, 124, 142, and 144 can have a width of up to about ±3 inches, and a portion of flaps 122, 124, 142, and 144 can have a width adjacent panels 120 and 140 of about ±0.5 inches, although other sizes also can be provided. Adhesive panel 116 can have a width of about ±0.750 inches, and panel 107 can have edges that extend at an angle of about ±20 degrees with respect to fold lines 153 and 155. The width of remainder portion 136 between tear line segment 175 and fold line 135 can be about ±2.000 inches, although other sizes also can be provided. If a reinforcing layer is included, such layer can have a width of about ±5 inches, although other sizes also can be provided. The exemplary spacing/distances being variable, depending on the size of the blank.

Although not shown, end flaps 22, 42, 122, 142 could be removable from the carton formed from blank 5 or blank 105. The end flaps 22, 42, 122, 142 could be detachable, such as by replacing respective fold lines 23, 43, 123, 143 with tear lines. Further, one or both of end flaps 22, 42 or one or both of end flaps 122, 142 could be connected to end flaps 12 or 32, or 112 or 132 and could be removed with dispensing flap 70 or 170 when the dispensing flap 70 or 170 is detached along respective tear line 72 or 172 and hinged along respective fold line 17 or 117. Further still, end flaps 12 and 112 can be detachable from the carton formed from blank 5 or 105 if the header display is not to be used.

The blank further can be formed with reinforcing strips to provide additional support for the panels, the carton, or the package in general and can be disposed on any panel, end flap, or combination thereof. As shown, the interior surfaces of the carton are reinforced with reinforcing strips, which are then enclosed in the carton. Portions of the reinforcing strip(s) can be detached with the opening flap.

Generally, the carton or package is filled with items, such as containers, individually wrapped foodstuffs, cleaning products, batteries, etc. for example, to form a package. The carton can be sized to accommodate any number of items. Generally, the items are contained in the package for shipping to a point-of-sale vendor (e.g., grocery store). Optionally, at the point-of-sale vendor, the package can be converted to a display unit with a display header for displaying the items to consumers.

The flaps and panels detailed herein generally are secured to form a sleeve, package, or carton. It is understood that forming the sleeve, carton, or package, packing the sleeve, carton, or package, and/or loading the sleeve, carton, or package and methods that differ than the forming, packing, and/or loading configurations discussed herein are within the scope of the disclosure.

In general, the blank, sleeve, or carton may be constructed from paperboard having a caliper of at least about 13, for example, so that it is heavier and more rigid than ordinary paper. The blank, sleeve, or carton can also be constructed of other materials, such as cardboard, or any other material having properties suitable for enabling the carton to function at least generally as described above.

The blank, sleeve, or carton can be coated with, for example, a clay coating. The clay coating may then be printed over with product, advertising, and other information or images. The blank, sleeve, or carton may then be coated with a varnish to protect information printed on the blanks, sleeves, or cartons. The blanks, sleeves, or cartons may also be coated with, for example, a moisture barrier layer, on either or both sides of the blanks, sleeves, or cartons. The blanks, sleeves, or cartons can also be laminated to or coated with one or more sheet-like materials at selected panels or panel sections.

The above embodiments may be described as having one or panels adhered together by glue. The term "glue" is intended to encompass all manner of adhesives commonly used to secure panels in place, and the adhesive material can be replaced by, or supplemented with any suitable fastening devices.

The term "line" as used herein includes not only straight lines, but also other types of lines such as curved, curvilinear or angularly displaced lines. In accordance with the exemplary embodiments, a fold line can be any substantially linear, although not necessarily straight, form of weakening that facilitates folding therealong. More specifically, but not for the purpose of narrowing the scope of the present disclosure, fold lines can include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting or creasing is used to create a fold line, typically the cutting will not be overly extensive in a manner that might cause a reasonable user to incorrectly consider the fold line to be a tear line.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. It is within the scope of the present disclosure for each of the tear lines to be replaced with a continuous slit, cut line, or the like. For example, a cut line can be a continuous slit or could be wider than a slit without departing from the present disclosure.

Any dimensions shown in the figures are exemplary only and can be expanded or contracted, such as to accommodate items of different sizes, configurations, or dimensions. These dimensions should not be construed as limiting in any manner.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton comprising:

a first side panel, a second side panel, a third side panel, and a fourth side panel;

a first end formed by a first side panel end flap, a second side panel end flap, a third side panel end flap, and a fourth side panel end flap; the first side panel end flap being connected to the first side panel along a first fold line; the second side panel end flap being connected to the second side panel along a second fold line; the third side panel end flap being connected to the third side panel along a third fold line; the fourth side panel end flap being connected to the fourth side panel along a fourth fold line; a first portion in the first end defined between a peripheral edge of the first side panel end flap and a fifth fold line in the first side panel end flap; the third side panel end flap overlapping and being adhered to the first portion of the first side panel end flap;

a second end formed by a fifth side panel end flap, a sixth side panel end flap, a seventh side panel end flap, and an eighth side panel end flap;

an opening flap including a second portion defined in the third side panel by a tear line pattern; the opening flap being separable along the tear line pattern and being foldable along the fifth fold line to dispose the first side panel end flap and the third side panel end flap in a facing relationship and to dispose the second portion inside the carton in a facing relationship with an inner surface of the first side panel;

wherein the second panel end flap and the fourth panel end flap remain attached along the second fold line and the fourth fold line, respectively, to the carton when the opening flap is separated along the tear line pattern and folded along the fifth fold line.

2. The carton of claim 1 wherein the entirety of the second portion is disposed inside the carton.

3. The carton of claim 2 wherein, when the opening flap is folded along the fifth fold line, at least a section of the third panel end flap extends inside the carton.

4. The carton of claim 2 wherein the tear line pattern includes a finger flap and wherein detachment along the tear line pattern is initiated at the finger flap.

5. The carton of claim 2 wherein at least one tuck-in flap is included in the first side panel.

6. The carton of claim 5 wherein the at least one tuck-in flap is sized to receive an edge of the second portion when the opening flap is folded along the fifth fold line and the second portion is disposed inside the carton.

7. The carton of claim 1 wherein, when the opening flap is folded along the fifth fold line, the third panel end flap extends inside the carton.

8. The carton of claim 1 wherein the tear line pattern includes a finger flap and wherein detachment along the tear line pattern is initiated at the finger flap.

9. The carton of claim 1 wherein at least one tuck-in flap is included in the first side panel.

10. The carton of claim 9 wherein the at least one tuck-in flap is sized to receive an edge of the second portion when the opening flap is folded along the fifth fold line and the second portion is disposed inside the carton.

11. A package comprising:

a carton and a plurality of articles disposed in the carton;

the carton comprising:

a first side panel, a second side panel, a third side panel, and a fourth side panel;

a first end formed by a first side panel end flap, a second side panel end flap, a third side panel end flap, and a fourth side panel end flap; the first side panel end flap being connected to the first side panel along a first fold line; the second side panel end flap being connected to the second side panel along a second fold line; the third side panel end flap being connected to the third side panel along a third fold line; the fourth side panel end flap being connected to the fourth side panel along a fourth fold line; a first portion in the first end defined between a peripheral edge of the first side panel end flap and a fifth fold line in the first side panel end flap; the third side panel end flap overlapping and being adhered to the first portion of the first side panel end flap;

a second end formed by a fifth side panel end flap, a sixth side panel end flap, a seventh side panel end flap, and an eighth side panel end flap;

an opening flap including a second portion defined in the third side panel by a tear line pattern; the opening flap being separable along the tear line pattern and being foldable along the fifth fold line to dispose the first side panel end flap and the third side panel end flap in a facing relationship and to dispose the second portion inside the carton in a facing relationship with an inner surface of the first side panel;

wherein the second panel end flap and the fourth panel end flap remain attached along the second fold line and the fourth fold line, respectively, to the carton when the opening flap is separated along the tear line pattern and folded along the fifth fold line.

12. The package of claim 11 wherein the entirety of the second portion is disposed inside the carton.

13. The package of claim 12 wherein, when the opening flap is folded along the fifth fold line, at least a section of the third panel end flap extends inside the carton.

14. The package of claim 12 wherein the tear line pattern includes a finger flap and wherein detachment along the tear line pattern is initiated at the finger flap.

15. The package of claim 12 wherein at least one tuck-in flap is included in the first side panel.

16. The package of claim 15 wherein the at least one tuck-in flap is sized to receive an edge of the second portion when the opening flap is folded along the fifth fold line and the second portion is disposed inside the carton.

17. The package of claim 11 wherein, when the opening flap is folded along the fifth fold line, the third panel end flap extends inside the carton.

18. The package of claim 11 wherein the tear line pattern includes a finger flap and wherein detachment along the tear line pattern is initiated at the finger flap.

19. The package of claim 11 wherein at least one tuck-in flap is included in the first side panel.

20. The package of claim 19 wherein the at least one tuck-in flap is sized to receive and edge of the second portion when the opening flap is folded along the fifth fold line and the second portion is disposed inside the carton.

* * * * *